US005555714A

United States Patent [19]

Mladek et al.

[11] Patent Number: 5,555,714

[45] Date of Patent: Sep. 17, 1996

[54] COMBING ROLLER

[75] Inventors: Milos Mladek; Oldrich Tesar; Jaroslav Kaplan; Ladislav Pirkl, all of Usti nad Orlici; Dobroslav Musil, Brno, all of Czech Rep.

[73] Assignee: Rieter Elitex, Czech Rep.

[21] Appl. No.: 253,544

[22] Filed: Jun. 3, 1994

[30] Foreign Application Priority Data

Jun. 3, 1993 [CZ] Czech Rep. ..... 1060-93

[51] Int. Cl.[6] ..... D01H 4/00; D01G 15/00

[52] U.S. Cl. ..... 57/408; 19/112; 19/114; 57/327; 57/413

[58] Field of Search ..... 57/408, 411, 413, 57/327; 19/112, 114

[56] References Cited

U.S. PATENT DOCUMENTS

| | | | |
|---|---|---|---|
| 4,291,437 | 9/1981 | Yoshizawa et al. | 19/112 |
| 4,301,572 | 11/1981 | Miyamoto | 19/112 |
| 4,574,583 | 3/1986 | Stahlecker et al. | 19/112 |
| 4,590,645 | 5/1986 | Graf | 19/114 |
| 4,805,395 | 2/1989 | Stahlecker et al. | 19/114 |
| 4,858,275 | 8/1989 | Stahlecker et al. | 19/112 |
| 4,882,812 | 11/1989 | Fetzer et al. | 19/112 |
| 5,067,203 | 11/1991 | Hollmann | 19/114 |

FOREIGN PATENT DOCUMENTS

| | | | |
|---|---|---|---|
| 1939683 | 9/1970 | Germany . | |
| 3827344 | 2/1990 | Germany . | |
| 4120531 | 1/1992 | Germany | 19/112 |
| 1146822 | 7/1986 | Japan | 57/407 |
| 2268825 | 11/1987 | Japan | 19/114 |
| 3145426 | 6/1988 | Japan | 19/114 |
| 974186 | 11/1964 | United Kingdom | 19/114 |

*Primary Examiner*—William Stryjewski
*Attorney, Agent, or Firm*—Ostrolenk, Faber, Gerb & Soffen, LLP

[57] ABSTRACT

A combing roller for use in a singling-out device of an open-end spinning machine includes a cylindrical body having a plurality of teeth formed on its outer circumference. Each of the teeth is formed by the intersection of at least one spiral circumferential groove with a number of recesses. The recesses are disposed on the circumference of the cylindrical body at an angle of up to 45 degrees relative to the direction of a force generating line which is parallel to a rotational axis of the cylindrical body.

11 Claims, 7 Drawing Sheets

COMBING ROLLER

FIELD OF THE INVENTION

The present invention relates to a combing roller for use in a singling-out device of an open end spinning machine. The combing roller includes a cylindrical body having teeth formed on an outer circumference. The teeth are formed by the intersection of at least one spiral circumferential groove with a number of recesses formed on the cylindrical body. The invention also relates to a method of making a combing roller.

BACKGROUND OF THE INVENTION

Most conventional combing rollers are formed by a cylindrical body having a spiral circumferential groove located on an outer circumference of the cylindrical body. Saw-like teeth are mounted in the groove and perform a sliver singling-out operation.

At high rotational speeds required in conventional open end spinning machines, such combing rollers are unsatisfactory because the rollers have a relatively short service life. A subsequent surface treatment of the combing roller accentuates the problems caused by rolling as well as those of the saw-like teeth surface, which problems substantially hinder the combing roller function. Another drawback of such combing rollers is the tendency for impurities and fiber clusters to stick to the grooves formed between the tooth-free sections of the saw-like surface near the circumference of the cylindrical body which produces irregularities and other faults in the yarn being spun. An advantageous feature of such a conventional combing roller is that the teeth are formed on the surface in a spiral so that the number of teeth actually in engagement with a fiber sliver varies over time.

There are known combing rollers, e.g., as described in DE OS 19 39 683, in which saw-like teeth are formed on the surface of a cylindrical body by forming a spiral groove with axially oriented notches intersecting a groove upper part so as to create tooth front and back faces.

In an improvement described in DE 38 27 344, a combing roller includes a ring-like body having teeth formed on an outer circumference by substantially axially oriented notches which cooperate with circumferentially oriented gaps, wherein the circumferentially oriented gaps are deeper than the notches located between the teeth.

Because of the last-mentioned feature, the operating part of such a combing roller is similar to the combing roller with the saw-like surface because such a roller produces irregularities in the yarn being spun and causes fibers to stick to the lower sections of the gaps between the tooth rows. The fibers are drawn to a root of each tooth and, when transported into a feeding channel, the loosening of the fibers from the surface of the combing roller is partially obstructed, thereby destroying the uniformity of the yarn being spun.

However, the main drawback of such a combing roller is the axially oriented notches forming the front and back faces of the teeth. Because of this arrangement, whole rows of teeth of the combing roller simultaneously contact the sliver creating sudden impact forces and jerking motions acting on the sliver. This results in the sliver not being fed smoothly and continuously but intermittently and with a jerking motion causing harmful effects on the yarn being spun.

SUMMARY OF THE INVENTION

An object of the present invention is to provide a combing roller which results in the combing roller having a long service life and which eliminates the above-mentioned drawbacks of conventional combing rollers.

The object of the present invention is achieved by providing a combing roller for use in a singling-out device of an open end spinning machine including a cylindrical body having teeth formed on its outer circumference by the intersection of at least one spiral circumferential groove and a plurality of recesses. The recesses are disposed on the circumference of the cylindrical body at an angle of up to 45° relative to the direction of a force generating line which is parallel to a rotational axis of the cylindrical body.

In an advantageous embodiment, the recesses are oriented in a direction perpendicular to a spiral circumferential groove. In this embodiment, the teeth which are parallel to a tangential plane have a rectangular parallelogram shape which increases their service life. In cross section, a bottom surface of the spiral circumferential groove can form an arc which extends between the edges of adjacent teeth.

To adapt the combing roller to changing conditions, such as the composition of the fiber sliver, operating speed (RPM), and underpressure, the cross section of the spiral circumferential groove of another embodiment forms a straight line extending between the edges of adjacent teeth.

For other conditions, it is more suitable to form a bottom surface of the spiral circumferential groove to have a cross section that has a convex shape which extends in the direction of the spiral circumferential groove.

In all the above mentioned embodiments, it is advantageous if side walls of the spiral circumferential groove widen from the bottom surface to a top portion of the side walls. This feature improves the doffing of the fibers from the teeth while fibers are being singled out.

For various conditions, the depth of the recesses can be modified. For example, in the first embodiment, the depth of the recesses is greater than or equal to the depth of the spiral circumferential groove. A preferred embodiment is one where the recess depth is greater than the depth of the spiral circumferential groove by a multiple ranging from 0.05 to 0.5.

From the point of the view of ease of making the combing roller, a preferred embodiment is one with recesses arranged along the whole width of the outer circumference of the cylindrical body of the combing roller.

In another embodiment, the recess depth is less than the depth of the spiral circumferential groove.

To improve the guiding of the fibers being singled out on the circumference of the roller, the cylindrical body preferably has flanges formed on its faces. The flanges have a diameter that is greater than a distance equal to a diameter of an imaginary circle connecting the outer tip surfaces of the teeth minus twice the depth of the spiral circumferential groove.

The best results in guiding the fibers being singled out on the circumference of the cylindrical body of the combing roller are achieved if the flange diameter is greater than or equal to the diameter of the imaginary circle connecting the outer tip surfaces of the teeth. The cylindrical body is preferably made of steel which can be hardened.

The method of the making the combing roller requires that the cylindrical body be rotated during the formation of the recesses.

Other features and advantages of the present invention will become apparent from the following description of the invention which refers to the accompanying drawings.

BRIEF DESCRIPTION DF THE DRAWINGS

DETAILED DESCRIPTION OF THE INVENTION

Figure 1:
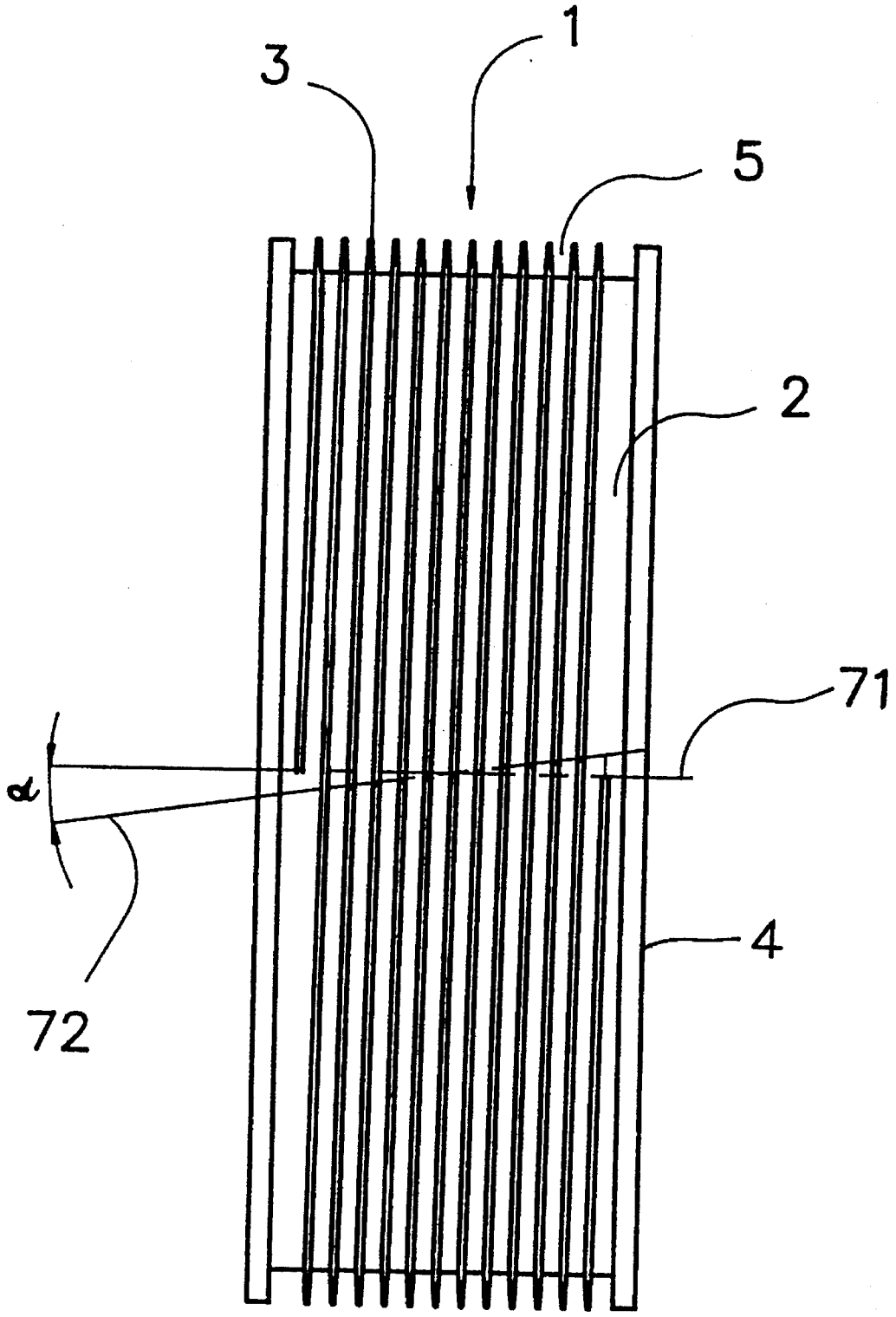
FIG. 1 is a front view of the combing roller of the present invention.
Figure 2:
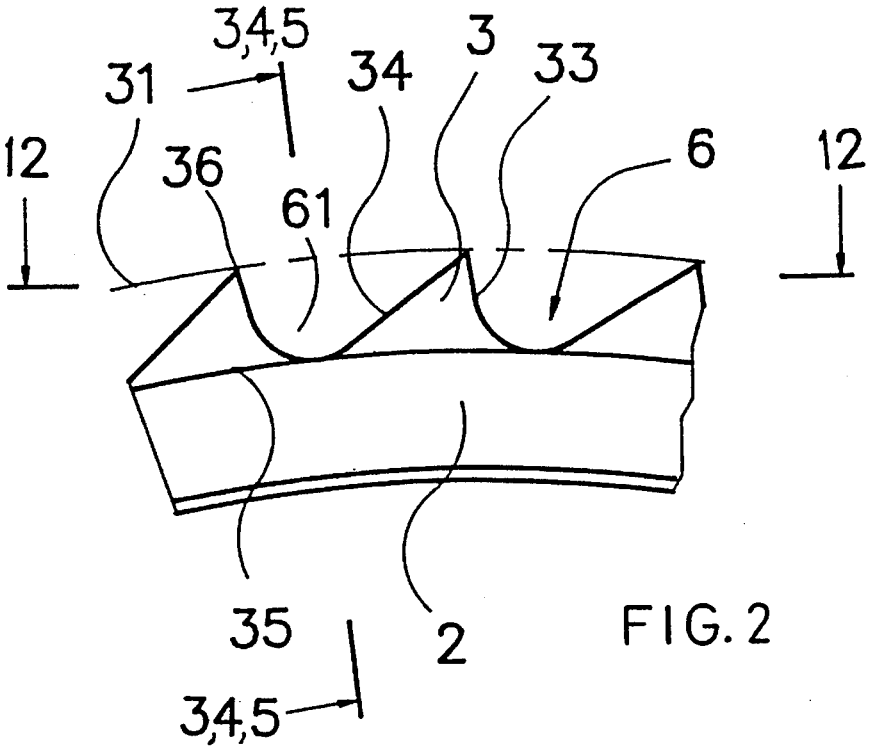
FIG. 2 is a side-view of the combing roller with the depth of the spiral circumferential groove and the depth of the recesses equal to each other.

Referring to the Figures, a combing roller 1 for use in a singling out device of an open end spinning machine (not shown) is shown in FIG. 1. Combing roller 1 is formed of a cylindrical body 2 having a hole 21 formed through the cylindrical body 2 for mounting the combing roller 1 on a drive shaft (not shown). The cylindrical body 2 also can be formed as a single piece together with a drive shaft, as an exterior hollow cylindrical body which is coaxially mounted on a bearing, or a cylindrical body fitted with a coaxial hole for fixedly mounting the cylindrical body on a drive shaft.

The cylindrical body 2 of the combing roller 1 has a plurality of teeth 3 formed on an outer circumference of the cylindrical body 2. The teeth 3 have external tip surfaces which can be connected by an imaginary circle 31. Front portions 22 of the cylindrical body 2 can have flanges 4 fixed thereto. The flange 4 can be made as a single piece with the cylindrical body 2.

The teeth 3 provided on the outer circumference of the cylindrical body 2 are formed by an intersection of at least one spiral circumferential groove 5 and a plurality of recesses 6 formed in the cylindrical body. The spiral circumferential groove has either a left-side or a right-side lead whose walls form the flanks 32 of the teeth 3. The plurality of recesses 6 formed on the cylindrical body 2 form front faces 33 and back faces 34 of the teeth 3. The recesses 6 are oriented on the circumference of the cylindrical body 2 at an angle $\alpha$ of up to 45° relative to a force generating line 71 of the cylindrical body 2, which is parallel to a rotational axis of the cylindrical body 2. In FIG. 1, the angle is shown by an auxiliary straight line 72. The diameter of the flanges 4 is greater than a distance equal to the diameter of the imaginary circle 31 connecting the outer tip surfaces of the teeth 3 minus twice the depth of the spiral circumferential groove 5. In the embodiment shown in FIG. 1, the diameter of the flanges 4 is greater than the diameter of the imaginary circle 31 and the diameters of the two flanges 4 are equal to each other. In other embodiments of the combing roller 1, the flanges 4 on the front portions 22 of the cylindrical body 2 need not be used, or only one flange 4 can be used, or the diameters of the two flanges can be different from each other.

The flanges 4 improve the guiding of the singled out fibers along the circumference of the cylindrical body 2. Each of the flanges 4 have a diameter greater than the diameter of the imaginary circle 31 to prevent the teeth from being damaged, for example, when a roller 1 is laid on a flat surface or when storing a plurality of combing rollers 1 side by side.

A bottom surface of the spiral circumferential groove can have a left-side or a right-side lead, whichever better suits particular conditions such as the particular fiber sliver being singled out, a required quality, or a required predetermined rotation speed of the combing roller. Another important technological parameter is the underpressure in the singling out device, in particular in the area where the singled out fibers are being doffed from the combing roller 1.

Figure 4:
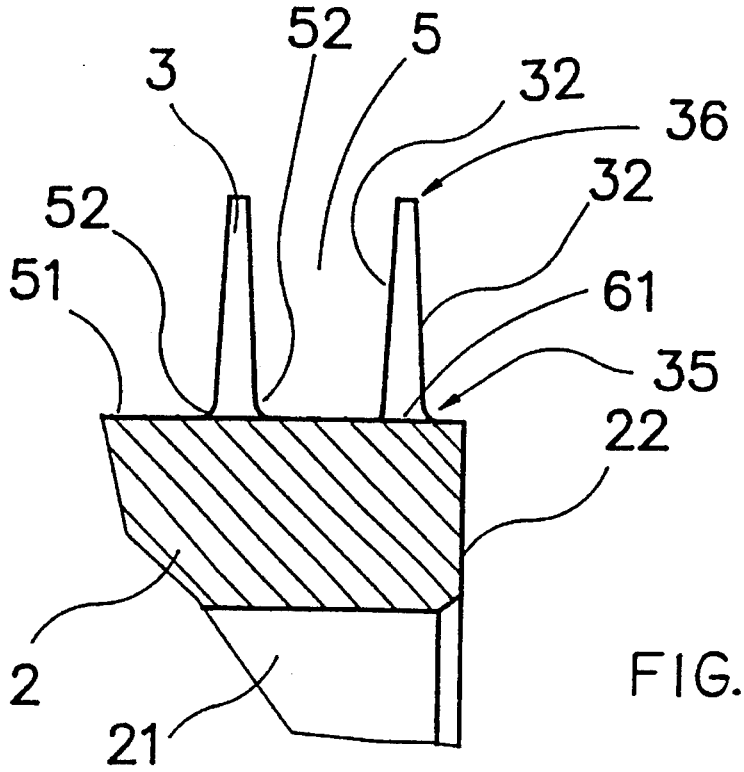
FIG. 4 is a sectional view taken along line A—A in FIG. 2 with a flat bottom surface of the spiral circumferential groove.
Figure 9:
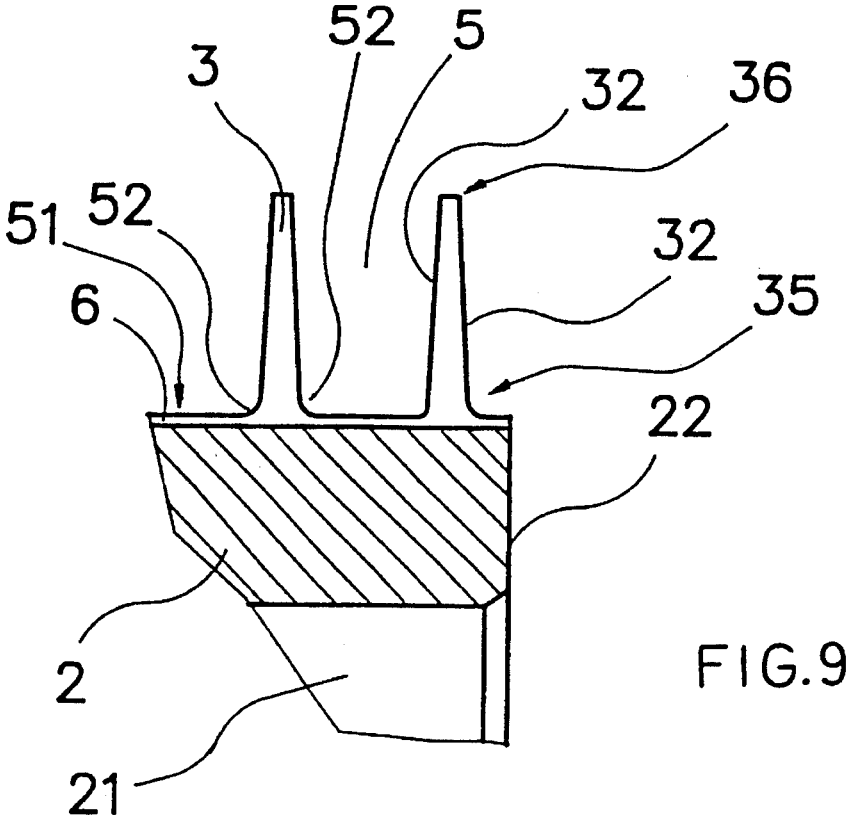
FIG. 9 is a sectional view taken along line A—A of the combing roller according to FIG. 8 with a flat bottom surface of the spiral circumferential groove.
Figure 10:
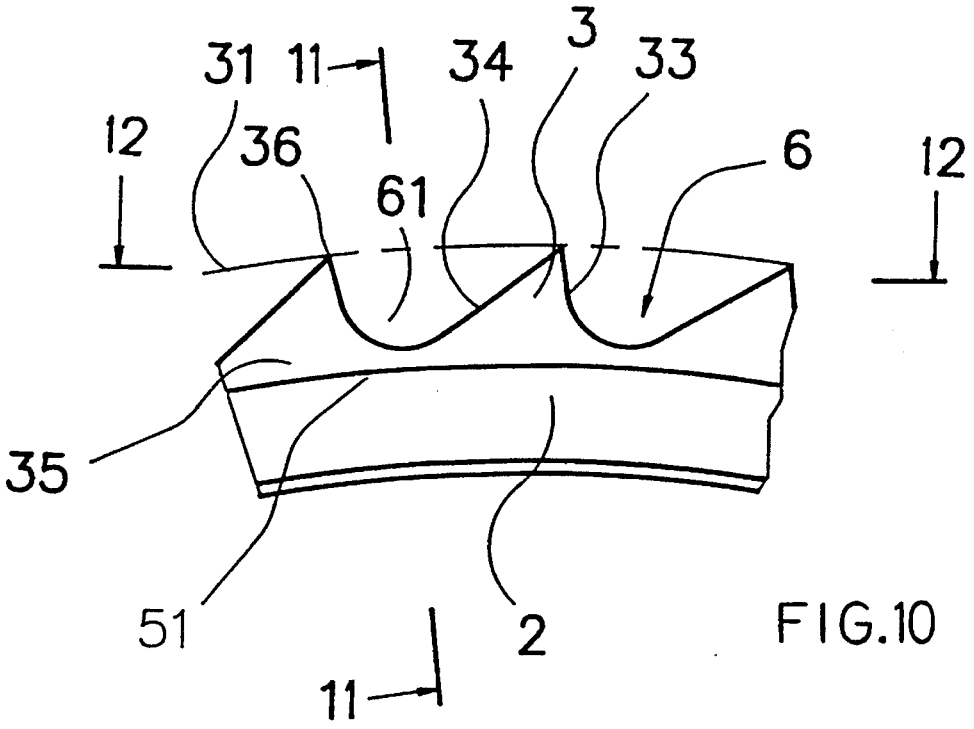
FIG. 10 is a detailed view of the side of the combing roller without flanges in which the recess depth is less than the depth of the spiral circumferential groove.
Figure 11:
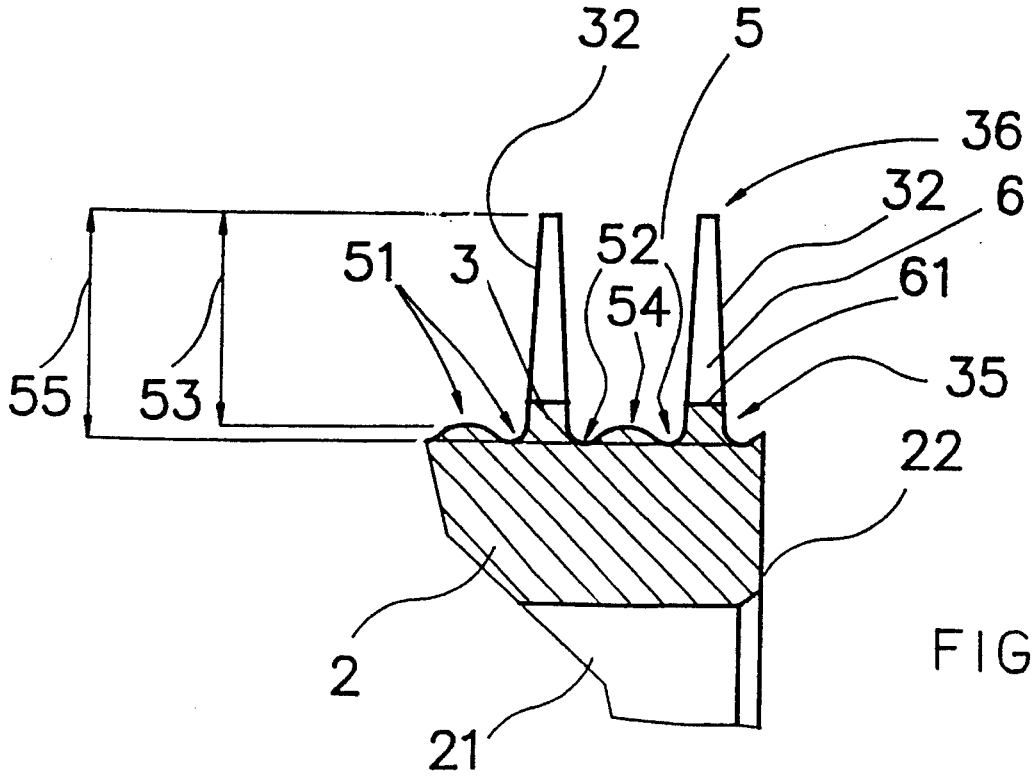
FIG. 11 is a sectional view along line A—A according to FIG. 10 with a convex bottom surface of the spiral circumferential groove.
Figure 12:
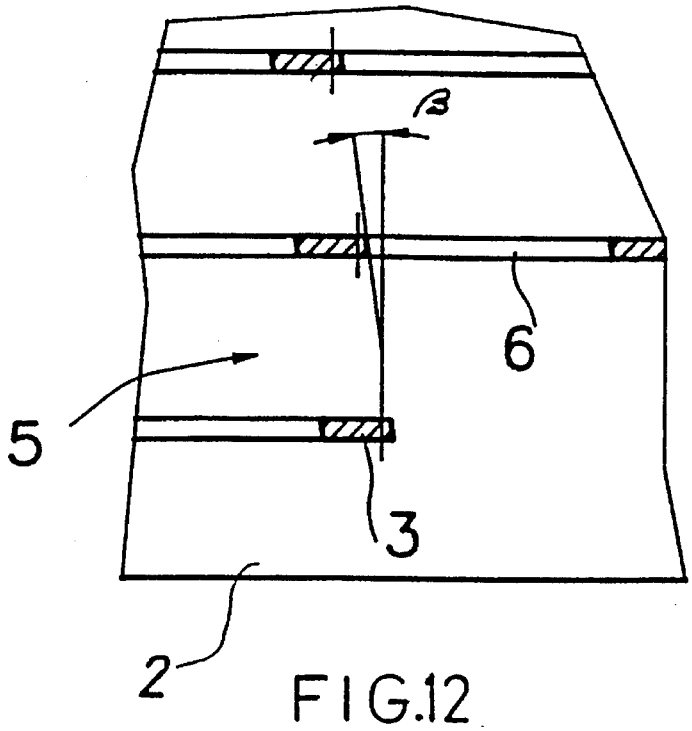
FIG. 12 is a developed view taken along line B—B in FIG. 2 according to FIGS. 2, 3, or 10.

In the embodiment shown in FIGS. 4 and 9, the bottom surface 51 of the spiral circumferential groove 5 is formed as a cylindrical surface having in cross section the shape of a straight line connecting the edges of the teeth 3 by means of arcs 52 which are connected to the flanks 32 of the teeth 3. The spiral circumferential groove 5 widens from the bottom surface 51 to a top portion thus forming an appropriate profile of teeth 3 which narrow from the root 35 of the teeth 3 to a tip 36.

The embodiment shown in FIG. 4 has a cross section of the bottom surface 51 formed as an arc which directly connects the edges of the teeth 3 at the arcs 52 which extend into the flanks 32 of the teeth 3. In the embodiment shown in FIG. 9, the cross section of the bottom surface 51 is raised above the upper surface of the cylindrical body 2 and connects the teeth 3 at the arcs 52 which extend into the flanks 32.

Another embodiment of the bottom surface 51 of the spiral circumferential groove, shown in FIGS. 5, 6, 7 and 11, features a convex bottom surface. In other words, the depth of the spiral circumferential groove is greater on its edges than in its middle, and the edge sections are connected by the arcs 52 which extend into the flanks 32 of the teeth 3.

Figure 8:
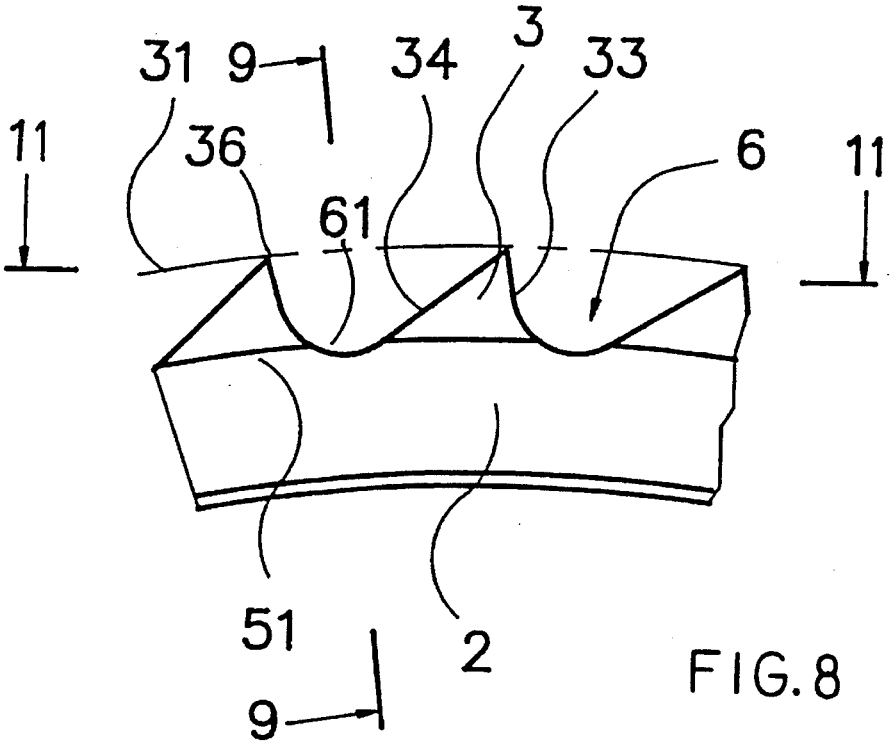
FIG. 8 is a detail of a part of the side-view of the combing roller without flanges in which the recess depth is greater than the depth of the spiral circumferential groove.

The depth of the recesses 6 which intersect with the spiral circumferential groove to form the teeth 3 can also vary. In the embodiment shown in FIGS. 8 and 9, the recess depth is greater than or equal to the depth of the spiral circumferential groove 5. A preferred embodiment is one in which the recess depth 6 exceeds the depth of the spiral circumferential groove 5 by a multiple ranging from 0.05 to 0.5.

In the embodiment having the convex bottom surface 51 of the spiral circumferential groove 5, the following variants are contemplated.

Figure 5:
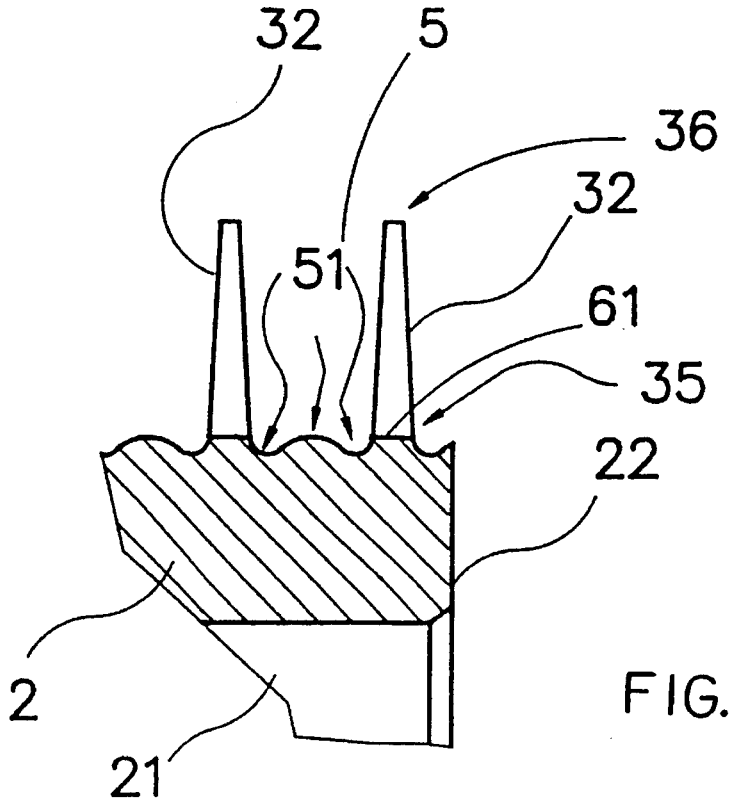
FIG. 5 is a sectional view taken along line A—A in FIG. 2 with a convex bottom surface of the spiral circumferential groove and having a recess depth equal to the minimum depth of the spiral circumferential groove.

In the embodiment shown in FIG. 5, the depth of the recess equals a minimum depth 53 of the spiral circumferential groove 5. The bottom surface of the spiral circumferential groove 5 is formed as a rotary surface in this embodiment.

Figure 7:
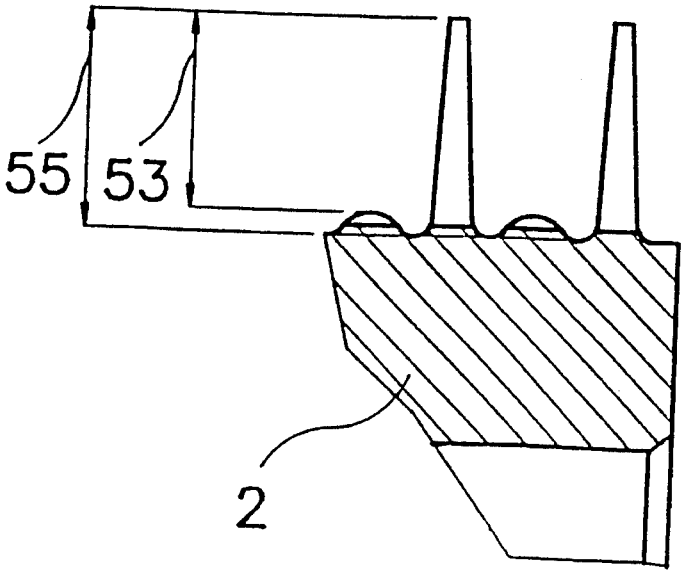
FIG. 7 is the same sectional view as in FIG. 5 wherein the recess depth is greater than the smallest depth of the spiral circumferential groove and less than the greatest depth of the spiral circumferential groove.

In the embodiment shown in FIG. 7, the depth of the recess 6 is greater than the minimum depth 53 of the spiral circumferential groove 5. The rotary surface of the bottom of the spiral circumferential groove 5 is in its convex section 54 interrupted by the lower surfaces 61 of the recess 6. The front faces 33 and the back faces 34 of the teeth 3 thus formed are larger than the flanks 32 of the teeth 3 which facilitates the loosening of the fibers from the surface of the combing roller, as well as, the singling-out process. At the same time, the depth of the recesses 6 is less than a maximum depth 55 of the spiral circumferential groove 5.

Figure 6:
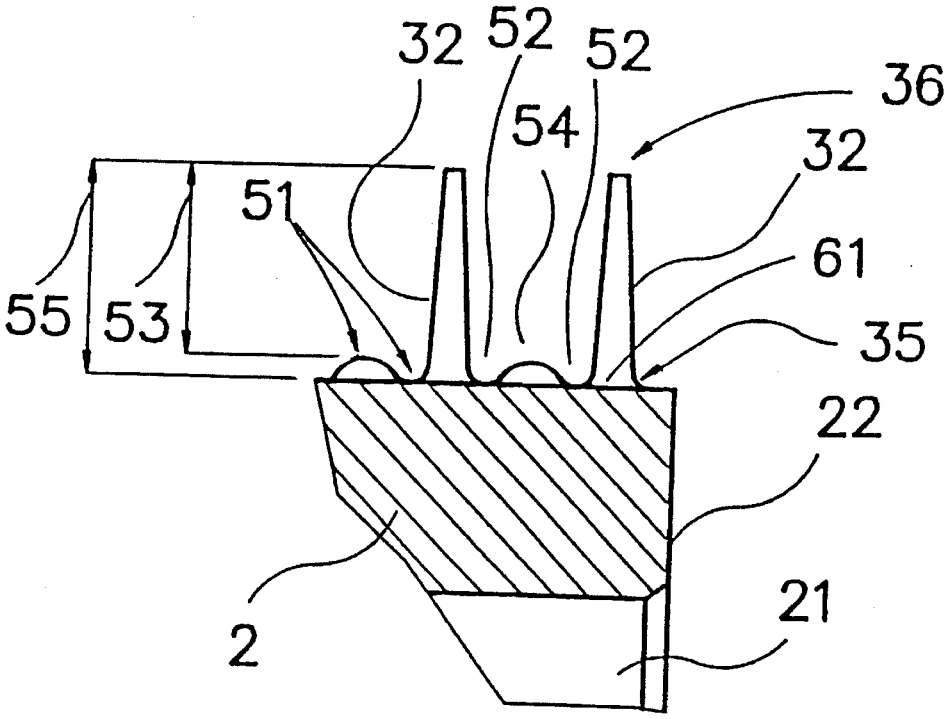
FIG. 6 is the same sectional view as in FIG. 5 wherein the recess depth is equal to the maximum depth of the spiral circumferential groove.

In the embodiment shown in FIG. 6, the depth of the recesses 6 is equal to the maximum depth 55 of the spiral circumferential groove-or it can be greater than the maximum depth 55 of the spiral circumferential groove 5. In this embodiment, the front faces 33 and the back faces 34 of the teeth 3 are still more elongated than the tooth flanks 32 because the whole rotary surface of the bottom of the spiral circumferential groove 5 is interrupted by the recesses 6.

If the bottom 51 of the spiral circumferential groove 5 is formed as a cylindrical surface, as shown in FIG. 9, and if at the same time the depth of the recesses 6 is made greater than the depth of the spiral circumferential groove 5, the cylindrical surface of the bottom 51 of the spiral circumferential groove 5 is interrupted by the lower surface 61 of the recesses 6. The front faces 33 and the back faces 34 of the teeth thus created are larger than the flanks 32 of the teeth 3 which facilitates loosening of the fibers from the surface of the combing roller 1 into the feeding channel at the end of the singling-out process.

Figure 3:
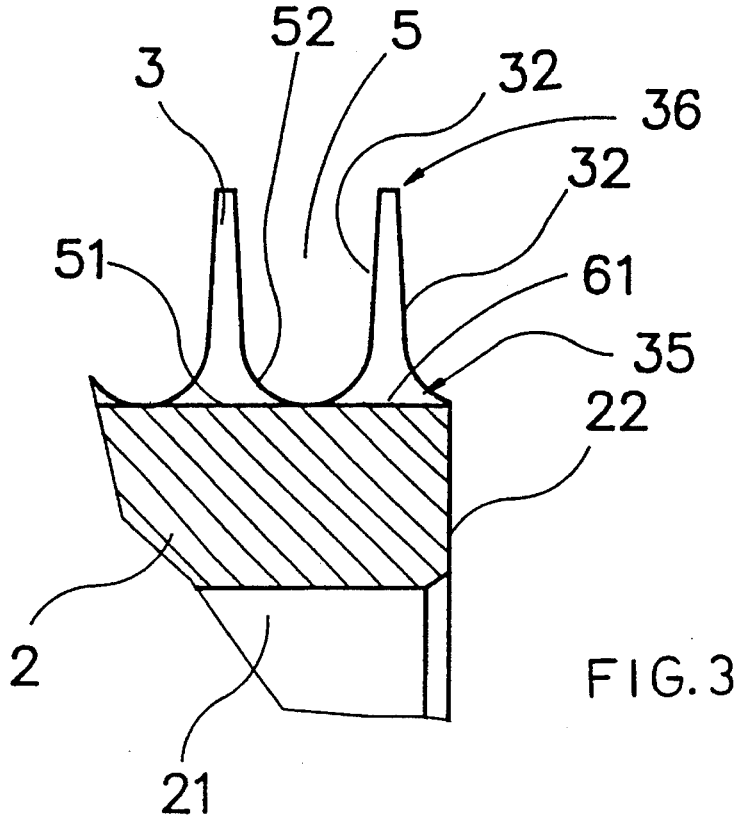
FIG. 3 is a sectional view taken along line A—A in FIG. 2 showing an arc-like bottom surface of the spiral circumferential groove.

In the spiral circumferential groove 5 shown in FIG. 3, a bottom surface thereof has an arc-shaped cross section. Thus, the depth of the recess 6 can be greater than the depth of the spiral circumferential groove 5, and the rotary surface forming the bottom surface 51 of the spiral circumferential groove 5 is interrupted by the recesses.

When the depth of the recess 6 is equal to the depth of the spiral circumferential groove 5, the bottom surface is formed by the intersection of the rotary surface forming the bottom surface 51 of the spiral circumferential groove 5 and the surfaces of the recesses 6 that contact each other in the deepest section of the bottom of the spiral circumferential groove 5.

In another variant (not shown), the depth of the recess 6 varies cyclically along the circumference of the cylindrical body 2 of the combing roller 1 in such a manner that the depth of the recesses immediately following each other gradually increases up to a maximum and then again decreases to its initial depth with any number of complete increase/decrease cycles occurring along the circumference of the roller 1.

In another example (not shown), the depth of the recess 6 varies along the length of the recess 6 which allows for modification of the shape of the point of the tooth 3. For instance, the tooth point shape can be modified in such a way that in the middle of the circumference, the recesses 6 are deeper and the teeth 3 sharper so that, in operation, the fiber sliver fed into the middle section of the circumference of the revolving cylindrical body 2 of the combing roller 1 is being singled-out by the sharp teeth 3 of the middle section of the toothed outer circumference of the cylindrical body 2.

As shown in FIGS. 3 to 6, 7, 9 and 11, the length of the recesses can be various values, however, the length is never shorter than the distance between the outer edges of the roots 35 of the teeth 3 on the outer circumference of the cylindrical body 2.

In another embodiment, the depth of the recess 6 can be less than the depth of the spiral circumferential groove 5. In this embodiment, the most appropriate shape of the bottom surface 51 is that which forms in cross section an arc or a straight line, with the depth of the recess 6 being less than the straight flank 32 of the teeth 3. This embodiment is appropriate for processing high quality raw materials.

Because the rows of the teeth 3 of the cylindrical body 2 are set at an angle with respect to the rotational axis (not shown) which is parallel to the force generating line 71 shown in FIG. 1, the tooth rows 2 are oblique so that the teeth 3 of each row contacts the fiber sliver gradually, thus avoiding a jerking or sudden pulling action of the conventional combing roller.

Figure 13:
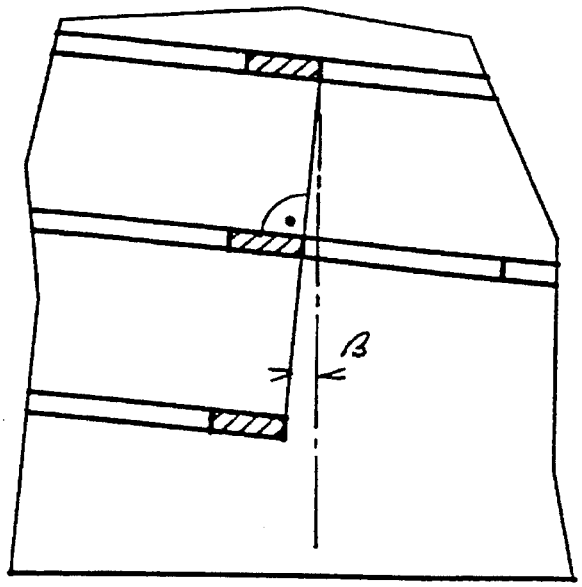
FIG. 13 is a detail view of the combing roller according to FIGS. 2, 8 or 10 with the recesses disposed perpendicular to the spiral circumferential groove.

The fronts 33 of the teeth 3 are the portions of the surface of the combing roller 1 which are exposed to the greatest strain. To reduce this strain and to increase their service life, and consequently, the service life of the combing roller 1 as a whole, the direction of the recess 6 is perpendicular to the spiral circumferential groove 5 so that the deviation angle $\alpha$ of the recess 6 is equal to the helix angle $\beta$ of the spiral circumferential groove 5, as shown in FIG. 13.

To increase the service life and the quality of the combing roller 1, the cylindrical body 2 is made of steel which can be hardened. After the spiral circumferential groove 5 has been produced, the cylindrical body 2 is hardened or at least partly hardened, then the recesses 6 are formed. If desired, subsequent heat treatment may be performed. Another indispensable operation is the removal of burrs and edges from the operating surface of the cylindrical body 2 of the combing roller 1. The operating surface of the cylindrical body 2 of the combing roller 1 can then receive a wear-resistant layer.

During the machining of the recesses 6, the cylindrical body 2 rotates. If both the rotation speed of the cylindrical body 2 and the feed rate of the machining tool are constant, the front projection of the recesses 6 is a straight line. If the feed rate of the machining tool is constant but the rotation speed of the cylindrical body varies in time, the front projection of the recesses 6 will have a curved shape.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A combing roller for use in a singling-out device of an open-end spinning machine, the combing roller comprising:

a cylindrical body having a circumference and a plurality of teeth formed on the circumference;

at least one spiral circumferential groove formed in the cylindrical body;

a plurality of recesses formed in the cylindrical body and intersecting with the at least one spiral circumferential groove to form the plurality of teeth; wherein the recesses are disposed on the circumference of the cylindrical body at an angle of about 5° to about 45° relative to a force generating line which is parallel to a rotational axis of the cylindrical body and the recesses are oriented in a direction that is substantially perpendicular to the spiral circumferential groove.

2. A combing roller as claimed in claim 1, wherein the spiral circumferential groove has a bottom surface which forms an arc between adjacent teeth.

3. A combing roller as claimed in claim 1, wherein the spiral circumferential groove has a bottom surface forming a straight line between adjacent teeth.

4. A combing roller as claimed in claim 1, wherein the spiral circumferential groove has side walls which widen from a bottom portion to a top portion of the spiral circumferential groove.

5. A combing roller as claimed in claim 1, wherein a depth of each of the recesses is less than a depth of the spiral circumferential groove, wherein the depth is measured as a distance between a top most point and bottom most point of an tooth adjacent a respective recess.

6. A combing roller as claimed in claim 5, wherein the teeth have outer tip surfaces and the cylindrical body has at least one flange having a diameter greater than a distance equal to a diameter of an imaginary circle which connects each of the outer tip surfaces of the teeth minus twice the depth of the spiral circumferential groove.

7. A combing roller as claimed in claim 1, wherein the cylindrical body is made of hardened steel.

8. A combing roller as claimed in claim 1, wherein a depth of each of the recess is greater than or equal to a depth of the spiral circumferential groove, wherein the depth is measured as a distance between a top most point and bottom most point of an tooth adjacent a respective recess.

9. A combing roller as claimed in claim 8, wherein the recesses are arranged along an entire width of the circumference of the cylindrical body.

10. A combing roller for use in a singling-out device of an open-end spinning machine, the combing roller comprising:

a cylindrical body having a circumference and a plurality of teeth formed on the circumference;

at least one spiral circumferential groove formed in the cylindrical body and having a bottom surface forming a convex curved surface between adjacent teeth;

a plurality of recesses formed in the cylindrical body and intersecting with the at least one spiral circumferential groove to form the plurality of teeth wherein the recesses are disposed on the circumference of the cylindrical body at an angle of about 5° to about 45° relative to a force generating line which is parallel to a rotational axis of the cylindrical body.

11. A combing roller for use in a singling-out device of an open-end spinning machine, the combing roller comprising:

a cylindrical body having a circumference and a plurality of teeth formed on the circumference;

at least one spiral circumferential groove formed in the cylindrical body;

a plurality of recesses formed in the cylindrical body and intersecting with the at least one spiral circumferential groove to form the plurality of teeth; wherein the recesses are arranged along an entire width of the circumference of the cylindrical body and disposed on the circumference of the cylindrical body at an angle of about 5° to about 45° relative to a force generating line which is parallel to a rotational axis of the cylindrical body, the depth of the recesses being greater than the depth of the spiral circumferential groove by a multiple ranging from 0.05 to 0.5.

* * * * *